US009672767B2

(12) United States Patent
Kim

(10) Patent No.: US 9,672,767 B2
(45) Date of Patent: Jun. 6, 2017

(54) ORGANIC LIGHT EMITTING DISPLAY DEVICE

(71) Applicant: Samsung Display Co., Ltd., Yongin (KR)

(72) Inventor: Il Nam Kim, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 90 days.

(21) Appl. No.: 14/477,479

(22) Filed: Sep. 4, 2014

(65) Prior Publication Data

US 2015/0248855 A1 Sep. 3, 2015

(30) Foreign Application Priority Data

Mar. 3, 2014 (KR) ..... 10-2014-0025109

(51) Int. Cl.
*G09G 3/20* (2006.01)
*G09G 3/3233* (2016.01)
*G09G 3/3291* (2016.01)

(52) U.S. Cl.
CPC ..... *G09G 3/2074* (2013.01); *G09G 3/3233* (2013.01); *G09G 3/3291* (2013.01); *G09G 2300/0443* (2013.01); *G09G 2300/0452* (2013.01); *G09G 2310/0297* (2013.01); *G09G 2320/0666* (2013.01)

(58) Field of Classification Search
CPC ... G09G 2300/0443; G09G 2300/0452; G09G 2310/0297; G09G 2320/0666; G09G 3/2074; G09G 3/3233; G09G 3/3291; G09G 2320/043; G09G 2320/045; H01L 27/3213
See application file for complete search history.

(56) References Cited

U.S. PATENT DOCUMENTS 6,268,841 B1 * 7/2001 Cairns ..... G09G 3/2011 345/100
6,833,890 B2 12/2004 Hong et al.
7,075,601 B2 7/2006 Hong et al.
7,084,844 B2 * 8/2006 Yeo ..... G09G 3/3688 345/100

(Continued)

FOREIGN PATENT DOCUMENTS

KR 10-0709227 4/2007
KR 10-0855478 9/2008

(Continued)

*Primary Examiner* — Michael J Jansen, II

(74) *Attorney, Agent, or Firm* — H.C. Park & Associates, PLC

(57) ABSTRACT

An organic light emitting display device includes: a display panel including a red sub-pixel, a green sub-pixel, a first blue sub-pixel, and a second blue sub-pixel connected to scan lines and data lines; a scan driver configured to drive the plurality of scan lines; a data driver configured to output a data output signal in response to a data signal; a de-multiplexer circuit configured to sequentially provide the data output signal to a first data line, a second data line, a third data line, and a fourth data line, respectively to the red sub-pixel, the green sub-pixel, the first blue sub-pixel, and the second blue sub-pixel, in response to selection signals; and a timing controller configured to provide the data signal to the data driver, control the scan driver, and output the selection signals in response to an image signal and a control signal.

8 Claims, 14 Drawing Sheets

(56) References Cited

U.S. PATENT DOCUMENTS 7,573,452 B2 * 8/2009 Nathan ..... G09G 3/3677 345/100
7,782,275 B2 * 8/2010 Kim ..... G09G 3/325 345/76
7,884,786 B2 * 2/2011 Kim ..... G09G 3/3233 345/83
7,995,011 B2 * 8/2011 Jeong ..... G09G 3/006 315/169.3
8,130,181 B2 * 3/2012 Jeon ..... G09G 3/3233 315/169.3
8,174,514 B2 * 5/2012 Kim ..... G09G 3/3291 345/204
8,199,102 B2 * 6/2012 Lee ..... G09G 3/3688 345/100
8,264,478 B2 * 9/2012 Kim ..... G09G 3/3688 345/204
8,274,452 B2 * 9/2012 Kim ..... G09G 3/2003 313/484
8,285,037 B2 10/2012 Speirs et al.
8,330,152 B2 * 12/2012 So ..... H01L 27/3213 257/40
8,330,352 B2 * 12/2012 Sung ..... H01L 27/3216 313/504
8,334,545 B2 * 12/2012 Levermore ..... H01L 27/3213 257/40
8,390,652 B2 * 3/2013 Nakanishi ..... G09G 3/2003 345/204
8,497,957 B2 * 7/2013 Nakamura ..... G02B 5/201 349/106
8,552,944 B2 * 10/2013 Pei ..... G09G 3/3685 345/87
8,581,812 B2 * 11/2013 Kwak ..... G09G 3/3225 345/76
8,587,504 B2 * 11/2013 Joo ..... G09G 3/3614 345/204
8,680,518 B2 * 3/2014 Kim ..... H01L 27/3213 257/40
8,736,641 B2 * 5/2014 Byun et al. ..... 345/690
8,766,533 B2 * 7/2014 Kobayashi ..... G09G 3/3225 313/505
8,797,238 B2 * 8/2014 Kwak ..... G09G 3/3233 345/30
8,842,058 B2 * 9/2014 Kwak ..... G09G 3/3233 345/204
8,957,579 B2 * 2/2015 Weaver ..... H01L 51/5004 313/504
9,082,345 B2 * 7/2015 Yamamoto ..... G09G 3/3233
9,147,619 B2 * 9/2015 Lee ..... H01L 22/30
9,385,167 B2 * 7/2016 Hack ..... H01L 27/3213
2001/0050665 A1 * 12/2001 Yeo ..... G09G 3/3688 345/87
2005/0007352 A1 * 1/2005 Nathan ..... G09G 3/3677 345/204
2005/0168423 A1 * 8/2005 Hirata ..... G09G 3/2003 345/88
2005/0219276 A1 * 10/2005 Nose ..... G09G 3/3648 345/690
2005/0259052 A1 * 11/2005 Shin ..... G09G 3/325 345/77
2005/0264495 A1 * 12/2005 Shin ..... G09G 3/325 345/76
2005/0270257 A1 * 12/2005 Shin ..... G09G 3/3275 345/76
2006/0007768 A1 * 1/2006 Kim ..... G09G 3/3291 365/205
2006/0033422 A1 * 2/2006 Chao ..... H01L 27/3218 313/500
2006/0151745 A1 * 7/2006 Kim ..... G09G 3/325 252/301.16
2006/0227628 A1 * 10/2006 Eriguchi ..... G09G 3/20 365/189.07
2006/0232541 A1 * 10/2006 Kudo ..... G09G 3/3688 345/98
2006/0262130 A1 * 11/2006 Kim ..... G09G 3/3233 345/589
2006/0267885 A1 * 11/2006 Kwak ..... G09G 3/3233 345/76
2007/0008272 A1 * 1/2007 Li ..... G09G 3/3677 345/100
2007/0176869 A1 * 8/2007 Fujita ..... G09G 3/3413 345/88
2007/0222800 A1 * 9/2007 Fish ..... G09G 3/3233 345/694
2008/0036704 A1 * 2/2008 Kim ..... G09G 3/3233 345/76
2008/0055304 A1 * 3/2008 Ryu ..... G09G 3/2022 345/214
2008/0062089 A1 * 3/2008 Kim ..... G09G 3/3275 345/76
2008/0150874 A1 * 6/2008 Kida ..... G09G 3/3688 345/100
2008/0170008 A1 * 7/2008 Kim ..... G09G 3/2003 345/76
2008/0224968 A1 * 9/2008 Kashiwabara ..... G09G 3/2003 345/83
2008/0278466 A1 * 11/2008 Joo ..... G09G 3/3614 345/205
2009/0128458 A1 * 5/2009 Kim ..... G09G 3/3233 345/76
2009/0167648 A1 * 7/2009 Jeon ..... G09G 3/3233 345/76
2009/0179842 A1 * 7/2009 Chen ..... G02F 1/133514 345/88
2010/0103201 A1 * 4/2010 Nakanishi ..... G09G 3/2003 345/690
2010/0277677 A1 * 11/2010 Nakamura ..... G02B 5/201 349/106
2011/0025669 A1 * 2/2011 Kwak ..... G09G 3/3225 345/211
2011/0025723 A1 * 2/2011 Kim ..... H01L 27/3218 345/690
2011/0074838 A1 * 3/2011 Yamamoto ..... G09G 3/3233 345/690
2011/0108844 A1 * 5/2011 Kwak ..... G09G 3/3233 257/71
2011/0148944 A1 * 6/2011 Kobayashi ..... G09G 3/3225 345/690
2011/0233528 A1 * 9/2011 Levermore ..... H01L 27/3213 257/40
2012/0026143 A1 * 2/2012 Jang ..... G09G 5/00 345/211
2012/0075278 A1 * 3/2012 Hara ..... G09G 3/3208 345/211
2012/0105517 A1 * 5/2012 Yang ..... G09G 3/003 345/694
2012/0147065 A1 * 6/2012 Byun ..... G09G 3/3208 345/690
2012/0182284 A1 * 7/2012 Shieh ..... G09G 3/3266 345/214
2012/0299972 A1 * 11/2012 Bae ..... G09G 3/3614 345/690
2013/0070006 A1 * 3/2013 Yang ..... G09G 3/3225 345/694
2013/0335395 A1 * 12/2013 Zhan ..... G09G 3/3233 345/212
2014/0071177 A1 * 3/2014 Chu ..... G09G 3/2003 345/690
2014/0139124 A1 * 5/2014 Kim ..... G09G 3/3225 315/172
2014/0146030 A1 * 5/2014 Lee ..... G09G 3/3208 345/212
2014/0160096 A1 * 6/2014 Li ..... G09G 3/3614 345/204
2014/0160172 A1 * 6/2014 Lee ..... G09G 3/3607 345/690
2014/0191931 A1 * 7/2014 Kim ..... G09G 3/3291 345/76

(56) References Cited

U.S. PATENT DOCUMENTS

| | | | | |
|---|---|---|---|---|
| 2014/0198135 | A1* | 7/2014 | Eom | G09G 3/3275 345/690 |
| 2014/0203262 | A1* | 7/2014 | Kwak | G09G 3/3233 257/40 |
| 2014/0252336 | A1* | 9/2014 | Kobayashi | G09G 3/3225 257/40 |
| 2014/0307004 | A1* | 10/2014 | Roh | G09G 3/3208 345/690 |
| 2015/0009194 | A1* | 1/2015 | Kim | G09G 3/3233 345/211 |
| 2015/0009242 | A1* | 1/2015 | Park | G09G 3/3233 345/690 |
| 2015/0061983 | A1* | 3/2015 | Kim | G09G 3/3233 345/82 |
| 2015/0090961 | A1* | 4/2015 | Lee | H01L 22/30 257/40 |
| 2015/0243209 | A1* | 8/2015 | In | G09G 3/3208 345/76 |
| 2015/0248855 | A1* | 9/2015 | Kim | G09G 3/2074 345/590 |
| 2015/0287378 | A1* | 10/2015 | Jeong | G09G 3/3688 345/694 |
| 2015/0332628 | A1* | 11/2015 | Ren | G09G 3/3258 345/690 |
| 2016/0189670 | A1* | 6/2016 | Kim | G09G 5/02 345/690 |
| 2016/0189671 | A1* | 6/2016 | Kim | G09G 3/3291 345/690 |

FOREIGN PATENT DOCUMENTS

| | | |
|---|---|---|
| KR | 10-2012-0136644 | 12/2012 |
| KR | 10-2013-0034740 | 4/2013 |

* cited by examiner

ORGANIC LIGHT EMITTING DISPLAY DEVICE

CROSS-REFERENCE TO RELATED APPLICATIONS

This application claims priority from and the benefit of Korean Patent Application No. 10-2014-0025109, filed on Mar. 3, 2014, which is hereby incorporated by reference for all purposes as if fully set forth herein.

BACKGROUND

Field

Exemplary embodiments of the present inventive concepts described herein relate to an organic light-emitting display device.

Discussion of the Background

In recent years, importance of a flat panel display has increased together with development of a multimedia. Accordingly a variety of flat displays, such as Liquid Crystal Display, Field Emission Display, Organic Light Emitting Display, and so on had been developed. Among the flat displays, the organic light emitting display has a fast response speed below 1 ms, has low power consumption, and has a good a viewing angle. Thus, the organic light emitting display is in the spotlight as a next-generation flat display.

An organic light emitting display device includes a plurality of pixels, each of which has a red sub-pixel including organic light-emitting material of a red color, a green sub-pixel including organic light-emitting material of a green color, and a blue sub-pixel including organic light-emitting material of a blue color. Each pixel may express a color by mixing a red light, a green light, and a blue light that are emitted from sub-pixels, respectively.

A lifetime of the organic light emitting display device may depend on a lifetime of the organic light-emitting material. In particular, the lifetime of the organic light emitting display device may depend on an organic light-emitting material of a blue color, since the organic light-emitting material of blue has the shortest lifetime among organic light-emitting materials of red, green, and blue colors.

The organic light-emitting material of the blue color may be formed of a variety of materials. In the organic light emitting display device, an organic light-emitting material of a sky or light blue or a deep or dark blue is mainly used. The organic light emitting display device including the organic light-emitting material of the sky blue may have high efficiency to have advantages of reduced power consumption and increased lifetime, but may have reduced image quality due to its low color gamut. The organic light emitting display device including the organic light-emitting material of the deep blue may have improved color gamut to have increased image quality, but may have increased power consumption and shorter lifetime.

The above information disclosed in this Background section is only for enhancement of understanding of the background of the invention and therefore it may contain information that does not form any part of the prior art nor what the prior art may suggest to a person of ordinary skill in the art.

SUMMARY

Exemplary embodiments of the present invention provide a display device including an organic light emitting display device that may have improved color gamut, reduced power consumption, and increased lifetime.

Additional features of the invention will be set forth in the description which follows, and in part will be apparent from the description, or may be learned by practice of the invention.

An exemplary embodiment of the present invention discloses an organic light emitting display device including a display panel including: a red sub-pixel, a green sub-pixel, a first blue sub-pixel, and a second blue sub-pixel respectively connected to one of a plurality of scan lines and one of a plurality of data lines; a scan driver configured to drive the plurality of scan lines; a data driver configured to output a data output signal in response to a data signal; a de-multiplexer circuit configured to sequentially provide the data output signal to a first data line, a second data line, a third data line, and a fourth data line, respectively to the red sub-pixel, the green sub-pixel, the first blue sub-pixel, and the second blue sub-pixel, in response to selection signals; and a timing controller configured to provide the data signal to the data driver, control the scan driver, and output the selection signals in response to an image signal and a control signal.

With an exemplary embodiment of the present inventive concept, an organic light emitting display device includes a first blue sub-pixel, which emits sky blue and has an increased lifetime, and a second blue sub-pixel, which emits deep blue and has improved color gamut. Thus, a lifetime of the organic light emitting display device is extended, and a color gamut is improved. Further, a required color is expressed by adjusting light emitting times of the first and second blue sub-pixels.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
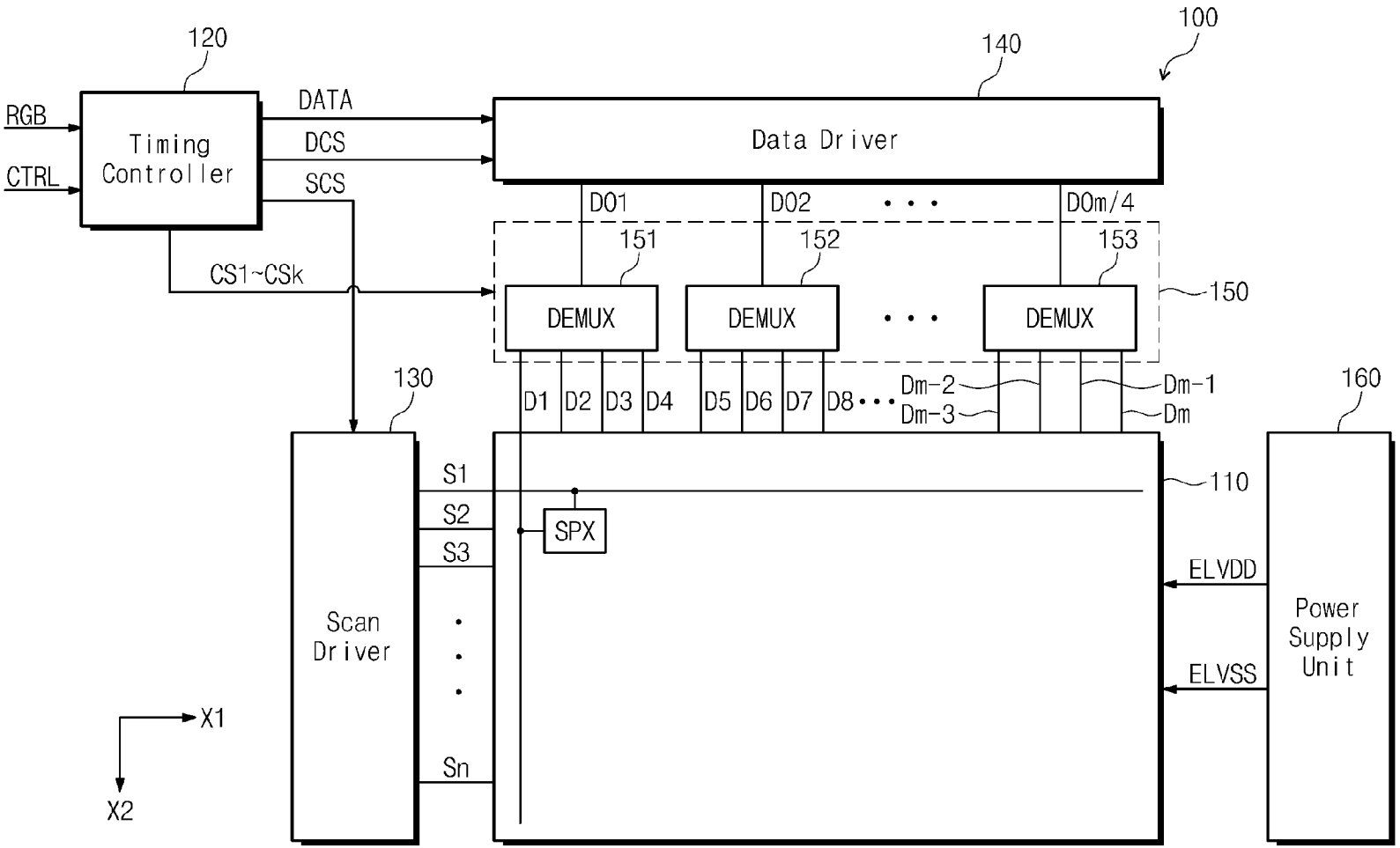
FIG. 1 is a block diagram schematically illustrating an organic light emitting display device according to an exemplary embodiment of the present inventive concept.

Embodiments will be described in detail with reference to the accompanying drawings. The present inventive concept, however, may be embodied in various different forms, and should not be construed as being limited only to the illustrated embodiments. Rather, these embodiments are provided as examples so that this disclosure will be thorough and complete, and will fully convey the concept of the inventive concept to those skilled in the art. Accordingly, known processes, elements, and techniques are not described with respect to some of the embodiments of the inventive concept. Unless otherwise noted, like reference numerals denote like elements throughout the attached drawings and written description, and thus descriptions will not be repeated. In the drawings, the sizes and relative sizes of layers and regions may be exaggerated for clarity.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

FIG. 1 is a block diagram schematically illustrating an organic light emitting display device according to an exemplary embodiment of the inventive concept.

Referring to FIG. 1, an organic light emitting display device 100 includes a display panel 110, a timing controller 120, a scan driver 130, a data driver 140, a de-multiplexer circuit 150, and a power supply unit 160.

The display panel 110 contains a plurality of scan lines S1 to Sn extending in a first direction X1, a plurality of data lines D1 to Dm extending in a second direction X2, and a plurality of sub-pixels SPX connected to the plurality of scan lines S1 to Sn and the plurality of data lines D1 to Dm. Each of the plurality of sub-pixels SPX may include a red sub-pixel, a green sub-pixel, a first blue sub-pixel, and a second blue sub-pixel. A configuration of each sub-pixel SPX will be more fully described later.

The timing controller 120 provides a data signal DATA and a data control signal DCS to the data driver 140 and a scan control signal SCS to the scan driver 130, in response to an image signal RGB and a control signal CTRL provided from an external device. The timing controller 120 transfers selection signals CS1 to CSk to the de-multiplexer circuit 150.

The scan driver 130 sequentially drives the plurality of scan lines S1 to Sn in response to a scan control signal SCS from the timing controller 120. The data driver 140 outputs data output signals DO1 to DOm/4 for driving the plurality of data lines D1 to Dm in response to the data signal DATA and the data control signal DCS from the timing controller 120. For example, the data output signal DO1 is provided to data lines D1, D2, D3, and D4 through the de-multiplexer circuit 150, the data output signal DO2 is provided to data lines D5, D6, D7, and D8 through the de-multiplexer circuit 150, and the data output signal DOm/4 is provided to data lines Dm-3, Dm-2, Dm-1, and Dm through the de-multiplexer circuit 150.

The de-multiplexer circuit 150 includes a plurality of de-multiplexers 151 to 153. The plurality of de-multiplexers 151 to 153 respectively corresponds to the data output signals DO1 to DOm/4. Each of the plurality of de-multiplexers 151 to 153 sequentially outputs a corresponding data output signal to four data lines that are connected to a corresponding de-multiplexer. For example, the de-multiplexer 151 sequentially provides the data output signal DO1 to four data lines D1 to D4, and the de-multiplexer 152 sequentially provides the data output signal DO2 to four data lines D5 to D8. The de-multiplexer circuit 150 may be formed at a predetermined area of the display panel 110 or implemented on a separate circuit board.

The power supply unit 160 provides a power supply voltage ELVDD and a ground voltage ELVSS to the sub-pixels SPX on the display panel 110.

Figure 2:
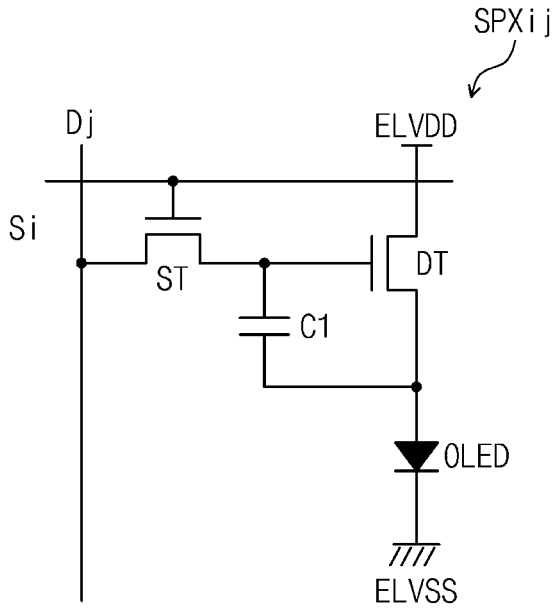
FIG. 2 is a circuit diagram schematically illustrating a sub-pixel shown in FIG. 1, according to an exemplary embodiment of the present inventive concept.

FIG. 2 is a circuit diagram schematically illustrating a sub-pixel shown in FIG. 1, according to an exemplary embodiment of the inventive concept.

Referring to FIG. 2, a sub-pixel SPXij is connected to an ith scan line Si and a jth data line Dj (i and j being a positive integer). The sub-pixel SPXij includes a switching transistor ST, a driving transistor DT, a capacitor C1, and an organic light emitting element OLED. The switching transistor ST transfers a data output signal supplied via the data line Dj to the driving transistor DT in response to a scan signal supplied to the scan line Si.

The driving transistor DT adjusts a current flowing to the organic light emitting diode OLED from a driving voltage ELVDD in response to the data output signal transferred via the switching transistor ST. The capacitor C1 is electrically connected between a gate electrode of the driving transistor DT and a ground voltage ELVSS. The capacitor C1 stores a voltage corresponding to a data output signal that is transferred to the gate electrode of the driving transistor DT. The voltage stored in the capacitor C1 may retain a turn-on state of the driving transistor DT during a first frame.

The organic light emitting diode OLED is electrically connected between a source electrode of the driving transistor DT and the ground voltage ELVSS and emits a light according to the current flowing from the driving voltage ELVDD via the driving transistor DT corresponding to a data signal supplied from the switching transistor ST.

The sub-pixel SPXij may further include at least one compensation transistor and at least one compensation capacitor that are configured to compensate for a threshold voltage of the driving transistor DT and at least one emitting transistor that is configured to selectively supply a current from the driving transistor DT to the organic light emitting diode OLED.

According to the exemplary embodiment of the invention, the sub-pixel SPXij may express a color by adjusting the amount of a current flowing from the power supply voltage ELVDD to the organic light emitting diode OLED by switching the driving transistor DT according to the data output signal, wherein a light emitting layer of the organic light emitting diode OLED is configured to emit light corresponding to the current.

Meanwhile, the sub-pixel SPXij may be divided into a red sub-pixel R including an organic light-emitting material of a red color, a green sub-pixel G including an organic light-emitting material of a green color, a first blue sub-pixel B1 including an organic light-emitting material of sky blue, and a second blue sub-pixel B2 including an organic light-emitting material of deep blue, according to organic light-emitting materials forming a light emitting layer for expression of a color.

The first and second blue sub-pixels B1 and B2 may have different brightness characteristics. When the same voltage is applied to an anode of the organic light emitting diode OLED, brightness of the first blue sub-pixel B1 including the organic light-emitting material of sky or light blue may be brighter than the second blue sub-pixel B2 including the organic light-emitting material of deep or dark blue.

Figure 3:
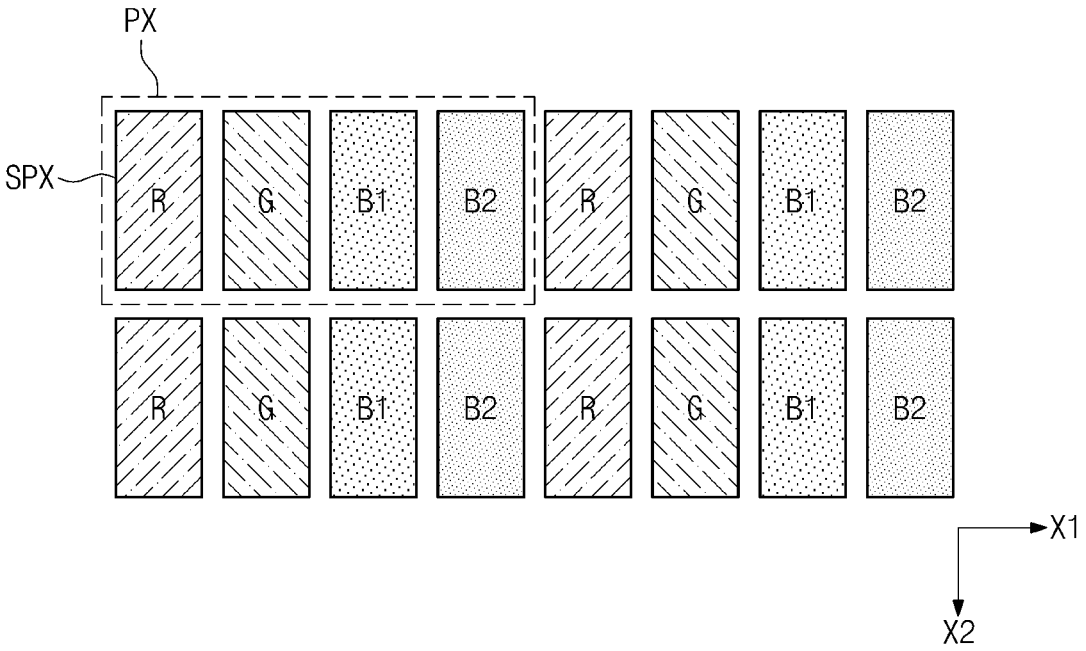
FIG. 3 is a diagram schematically illustrating an arrangement structure of pixels disposed on a display panel shown in FIG. 1, according to an exemplary embodiment of the present inventive concept.

FIG. 3 is a diagram schematically illustrating an arrangement structure of pixels disposed on a display panel shown in FIG. 1, according to an exemplary embodiment of the inventive concept.

Referring to FIG. 3, a pixel PX includes four sub-pixels SPX: a red sub-pixel R, a green sub-pixel G, a first blue sub-pixel B1, and a second blue sub-pixel B2. The red sub-pixel R, green sub-pixel G, first blue sub-pixel B1, and second blue sub-pixel B2 may be are arranged in order side by side and repeated along a first direction X1. The sub-pixel pattern arranged along the first direction X1 may be repeated along a second direction X2.

The red sub-pixel R, green sub-pixel G, first blue sub-pixel B1, and second blue sub-pixel B2 in one pixel PX are all connected to the same scan line and respectively connected to four data lines.

Figure 4:
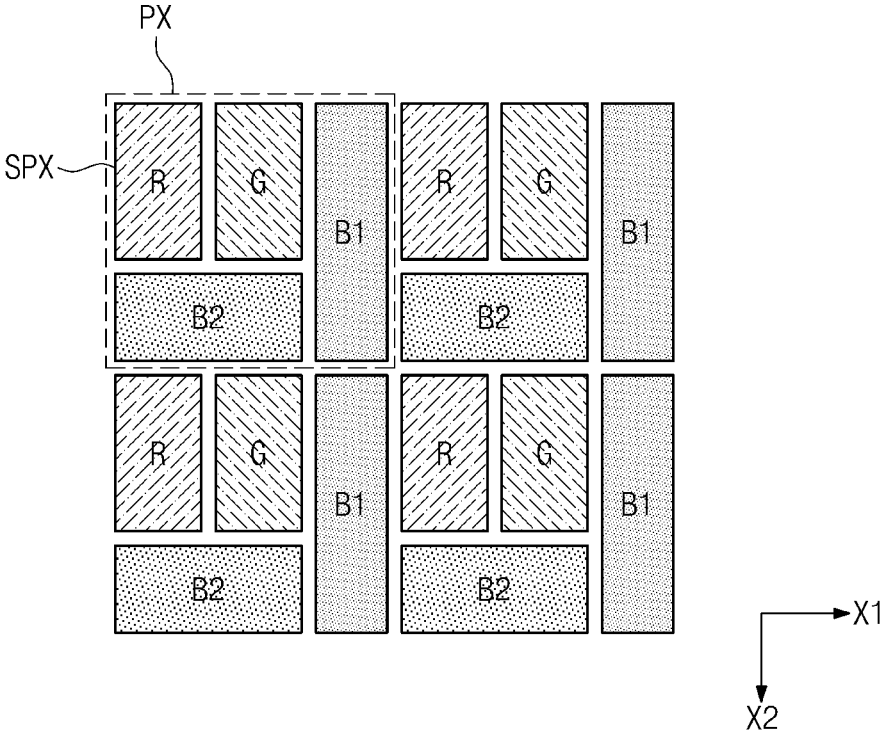
FIG. 4 is a diagram schematically illustrating an arrangement structure of pixels disposed on a display panel shown in FIG. 1, according to an exemplary embodiment of the present inventive concept.

FIG. 4 is a diagram schematically illustrating an arrangement structure of pixels disposed on a display panel shown in FIG. 1, according to an exemplary embodiment of the inventive concept.

Referring to FIG. 4, a pixel PX includes four sub-pixels SPX: a red sub-pixel R, a green sub-pixel G, a first blue sub-pixel B1, and a second blue sub-pixel B2. The red sub-pixel R, green sub-pixel G, and first blue sub-pixel B1 are disposed in order side by side and repeated along a first direction X1. The red sub-pixel R and the green sub-pixel G, together, are alternately disposed with the second blue sub-pixel B2 along a second direction X2. A first-direction length of the second blue sub-pixel B2 may be equal or about equal to a sum of a first-direction length of the red sub-pixel R and a first-direction length of the green sub-pixel G. A second-direction length of the first blue sub-pixel B1 may be equal to a sum of a second-direction length of the red sub-pixel R or the green sub-pixel G and a second-direction length of the second blue sub-pixel B2.

The red sub-pixel R, green sub-pixel G, first blue sub-pixel B1, and second blue sub-pixel B2 in one pixel PX are all connected to the same scan line and respectively connected to four data lines.

Figure 5:
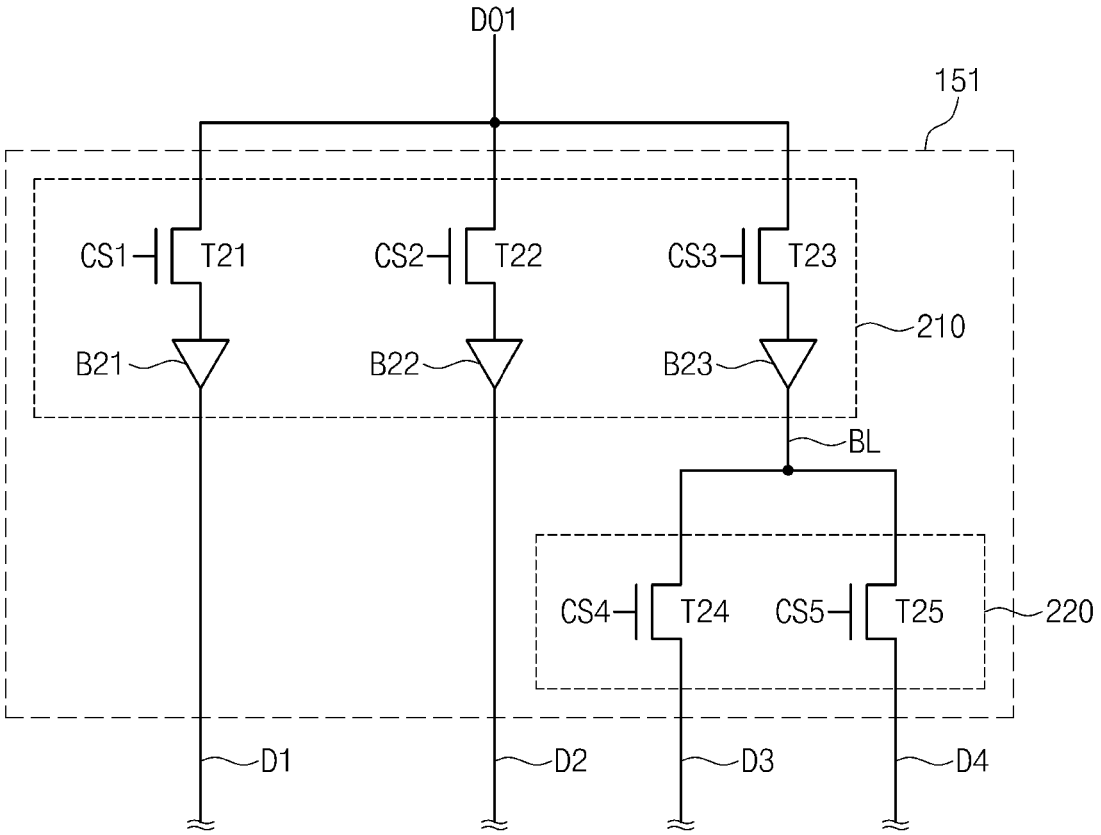
FIG. 5 is a circuit diagram schematically illustrating a de-multiplexer shown in FIG. 1, according to an exemplary embodiment of the present inventive concept.

FIG. 5 is a circuit diagram schematically illustrating a de-multiplexer shown in FIG. 1, according to an exemplary embodiment of the present inventive concept. De-multiplexers 152 to 153 shown in FIG. 1 may be configured substantially the same as the de-multiplexer 151 shown in FIG. 5, and their detailed configurations are thus omitted.

Referring to FIG. 5, a de-multiplexer 151 includes a first selection circuit 210 and a second selection circuit 220. The first selection circuit 210 outputs a data output signal DO1 to one of a first data line D1, a second data line D2, and a blue line BL, in response to selection signals CS1 to CS3 from a timing controller 120 shown in FIG. 1. The selection signals CS1 to CS3 may be a red selection signal, a green selection signal, and a blue selection signal.

The first selection circuit 210 includes first to third transistors T21 to T23 and first to third buffers B21 to B23. The first transistor T21 is connected to the data output signal DO1 and an input of the first buffer B21 and has a gate electrode connected to the red selection signal CS1. The second transistor T22 is connected to the data output signal DO1 and an input of the second buffer B22 and has a gate electrode connected to the green selection signal CS2. The third transistor T23 is connected to the data output signal DO1 and an input of the third buffer B23 and has a gate electrode connected to the blue selection signal CS3.

The first buffer B21 is connected between the first transistor T21 and the first data line D1, the second buffer B22 between the second transistor T22 and the second data line D2, and the third buffer B23 between the third transistor T23 and a blue line BL.

The second selection circuit 220 outputs the data output signal DO1 from the blue line BL to one of the third and fourth data lines D3 and D4, in response to selection signals CS4 and CS5 from the timing controller 120. The selection signals CS4 and CS5 may be first and second blue selection signals.

The second selection circuit 220 contains a fourth transistor T24 and a fifth transistor T25. The fourth transistor T24 is connected between the blue line BL and the third data line D3 and has a gate electrode connected to the first blue selection signal CS4. The fifth transistor T25 is connected between the blue line BL and the fourth data line D4 and has a gate electrode connected to the second blue selection signal CS5.

The following table 1 shows first and second blue selection signals CS4 and CS5 of which states are changed according to a mode of operation.

TABLE 1

| Mode of | Odd frames (F1, F3) | | Even frames (F2, F4) | |
|---|---|---|---|---|
| operation | CS4 | CS5 | CS4 | CS5 |
| Mix mode | H | L | L | H |
| Day mode | H | L | H | L |
| Night mode | L | H | L | H |
| Off mode | L | L | L | L |

FIGS. 6, 7, 8, and 9 are timing diagrams schematically illustrating a red selection signal, a green selection signal, a first blue selection signal, and a second blue selection signal according to modes of operation shown in a table 1.

Figure 6:
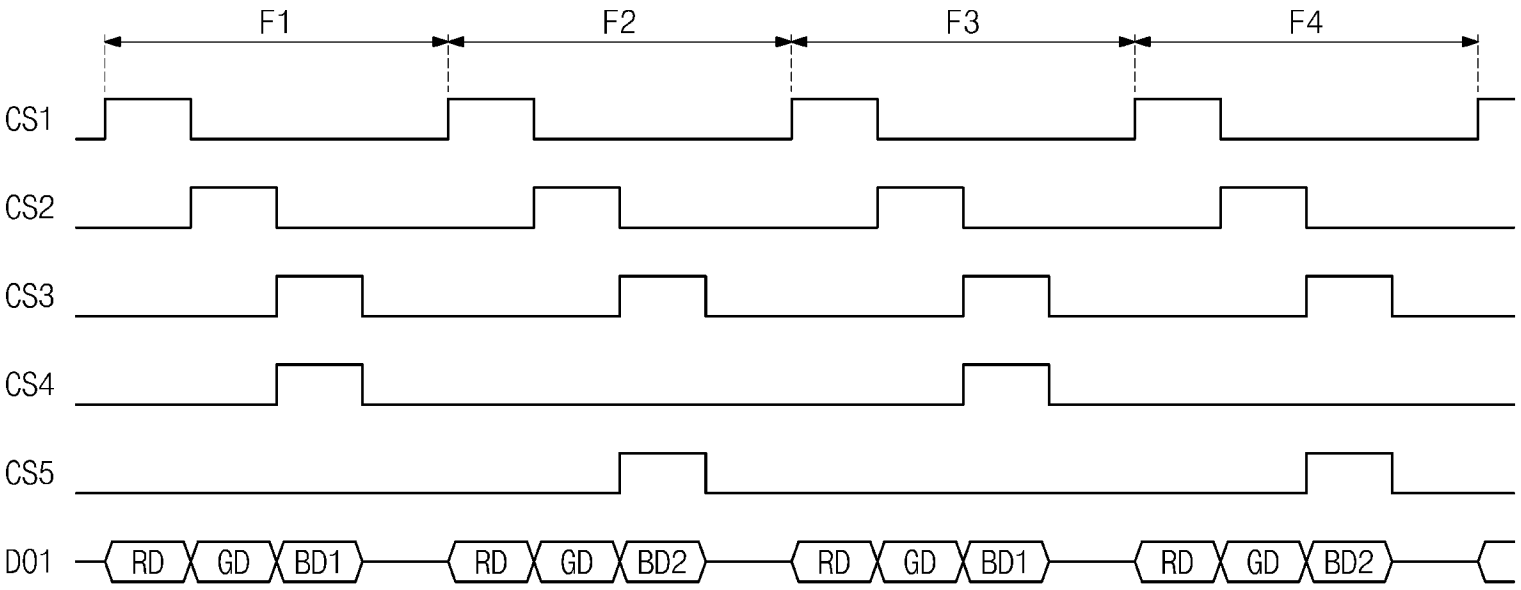
FIGS. 6, 7, 8, and 9 are timing diagrams schematically illustrating a red selection signal, a green selection signal, a first blue selection signal, and a second blue selection signal according to modes of operation shown in a table 1.

FIG. 6 is a timing diagram schematically illustrating a Mix mode. Referring to FIGS. 5 and 6, a red selection signal CS1, a green selection signal CS2, and a blue selection signal CS3, which are provided to a first selection circuit 210, are sequentially activated high. In odd-numbered frames F1 and F3, a first blue selection signal CS4 is activated high at the same time with the blue selection signal CS3. In even-numbered frames F2 and F4, a second blue selection signal CS5 is activated high at the same time with the blue selection signal CS3.

During the first frame F1, a data driver 140 illustrated in FIG. 1 sequentially outputs a red data RD for a red sub-pixel R, a green data GD for a green sub-pixel G, and a first blue data BD1 for a first blue sub-pixel B1 as a data output signal DO1. During the second frame F2, the data driver 140 sequentially outputs the red data RD for the red sub-pixel R, the green data GD for the green sub-pixel G, and a second blue data BD2 for a second blue sub-pixel B2 as a data output signal DO1. During the third frame F3, the data driver 140 sequentially outputs the red data RD for the red sub-pixel R, the green data GD for the green sub-pixel G, and the first blue data BD1 for the first blue sub-pixel B1 as a data output signal DO1. During the fourth frame F4, the data driver 140 sequentially outputs the red data RD for the red sub-pixel R, the green data GD for the green sub-pixel G, and the second blue data BD2 for the second blue sub-pixel B2.

Thus, even though the number of data lines D1 to Dm on a display panel 110 is "m", the data driver 140 may have output terminals for outputting m/4 data output signals DO1 to DOm/4. In particular, in the event that the data driver 140 is implemented with an integrated circuit, the number of output pins that the integrated circuit has may be substantially equal to a quarter of the number of data lines. Furthermore, even when the data driver 140 is suitable for a pixel of the display panel 110 that includes three sub-pixels, e.g., a red sub-pixel, a green sub-pixel, and/or a blue sub-pixel, the data driver 140 may be used for an organic light emitting display device 100 that includes a pixel PX including a red sub-pixel R, a green sub-pixel G, a first blue sub-pixel B1, and a second blue sub-pixel B2.

When a first blue selection signal CS4 is activated high at the same time a blue selection signal CS3 during the first frame F1 and a second blue selection signal CS5 is activated high at the same time with the blue selection signal CS3 during the second frame F2, a pixel PX may express a mixed color of sky blue and deep blue. Thus, a user may recognize an intermediate color of sky blue and deep blue. Under a control of a timing controller 120 shown in FIG. 1, in the mix mode, a first blue selection signal CS4 and a second blue selection signal CS5 are activated alternatively each frame.

Figure 7:
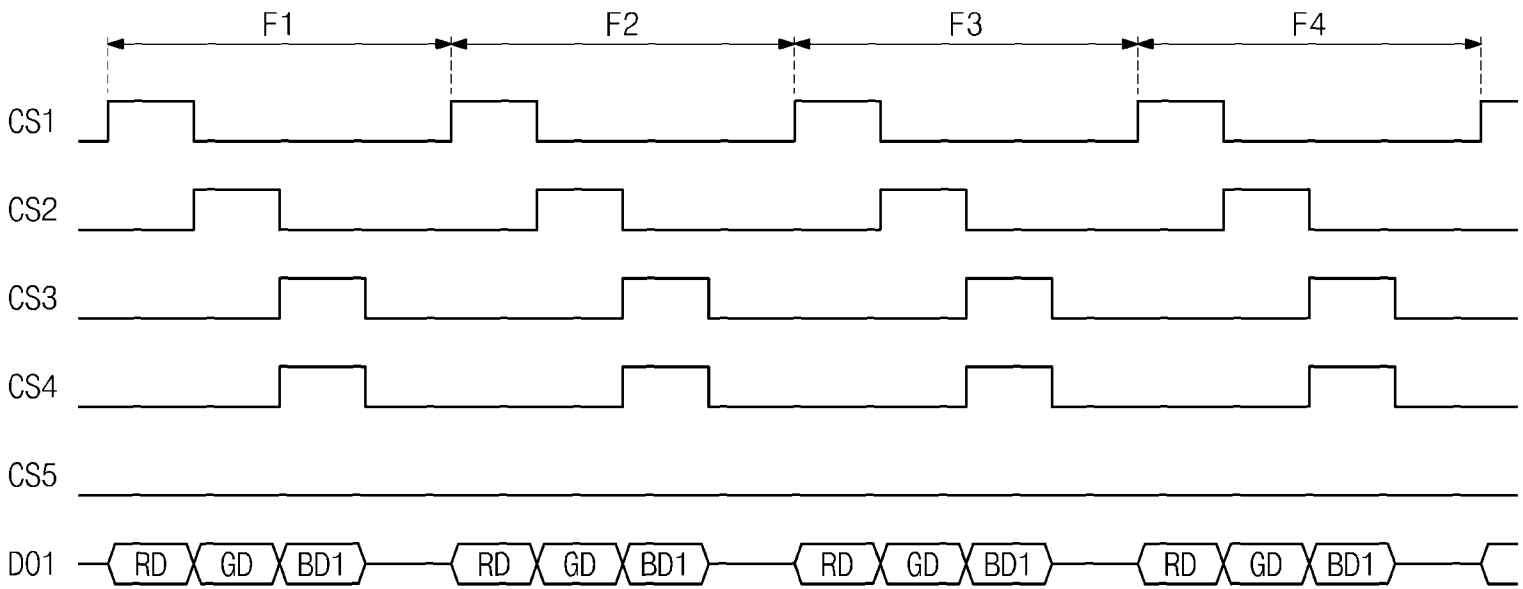

FIG. 7 is a timing diagram schematically illustrating a Day mode. Referring to FIGS. 5 and 7, during a light or Day mode, the timing controller 120 simultaneously activates the blue selection signal CS3 and the first blue selection signal CS4 high in the first and second frames F1 and F2, while maintaining the second blue selection signal CS5 at a low level in the first and second frames F1 and F2.

During the Day mode, the first blue sub-pixel B1 emitting sky blue is turned on by the first blue selection signal CS4, and the second blue sub-pixel B2 emitting deep blue is turned off by the second blue selection signal CS5. Thus, power consumption may be reduced, and a lifetime of the organic light emitting display device 100 may be extended.

Figure 8:
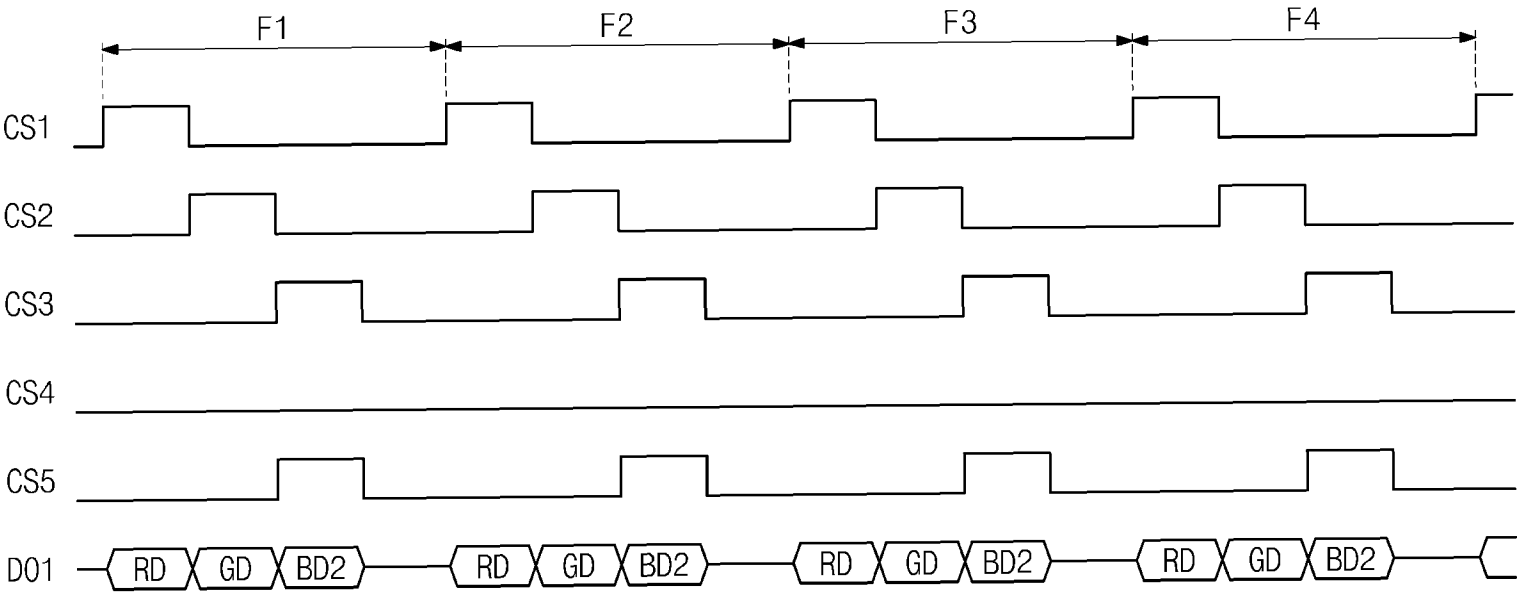

FIG. 8 is a timing diagram schematically illustrating a Night mode. Referring to FIGS. 5 and 8, during a dark or Night mode, the timing controller 120 simultaneously activates the blue selection signal CS3 and the second blue selection signal CS5 high in the first to fourth frames F1, F2, F3, and F4, with the first blue selection signal CS4 maintained at a low level in the first to fourth frames F1, F2, F3, and F4.

During the dark or Night mode, the first blue sub-pixel B1 emitting sky blue is turned off by the first blue selection signal CS4, and the second blue sub-pixel B2 emitting deep blue is turned on by the second blue selection signal CS5. Thus, color gamut may be improved.

Figure 9:
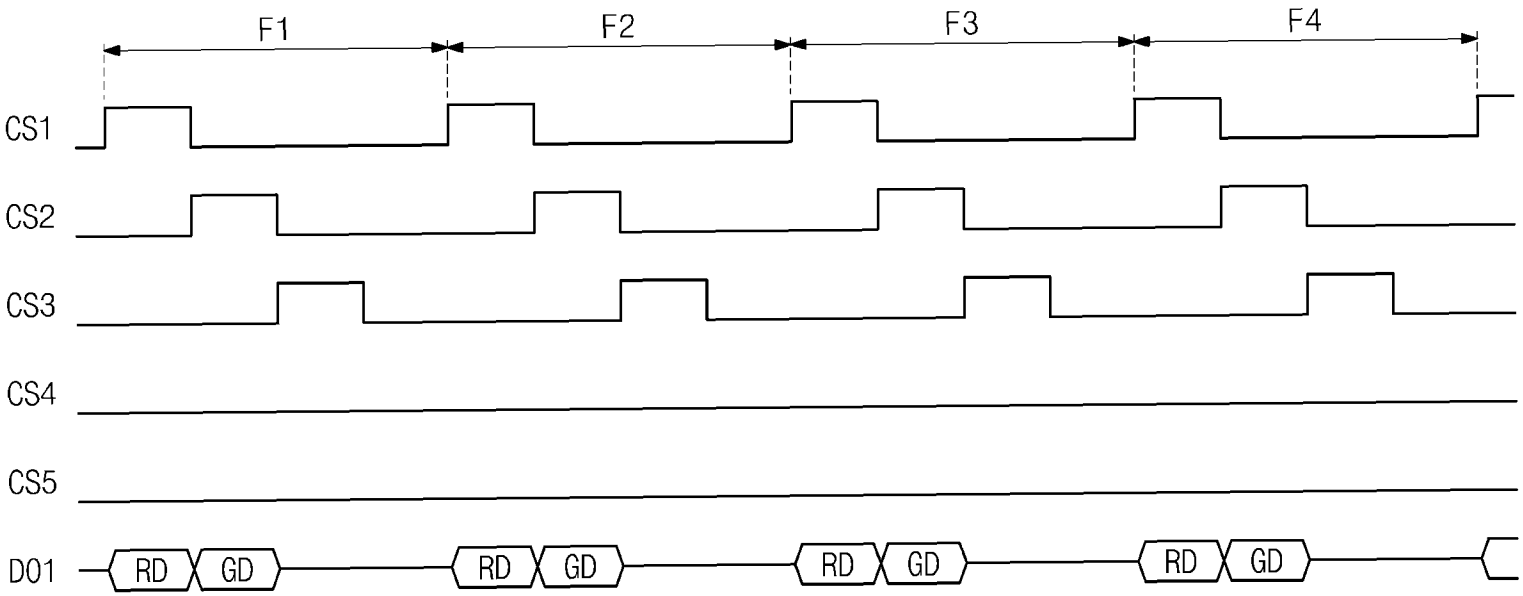

FIG. 9 is a timing diagram schematically illustrating an Off mode. Referring to FIGS. 5 and 9, during the Off mode, the timing controller 120 sets the first blue selection signal CS4 and the second blue selection signal CS5 to a low level in the first to fourth frames F1, F2, F3, and F4.

During the Off mode, the first blue sub-pixel B1 and the second blue sub-pixel B2 are turned off by the first blue selection signal CS4 and the second blue selection signal CS5.

Figure 10:
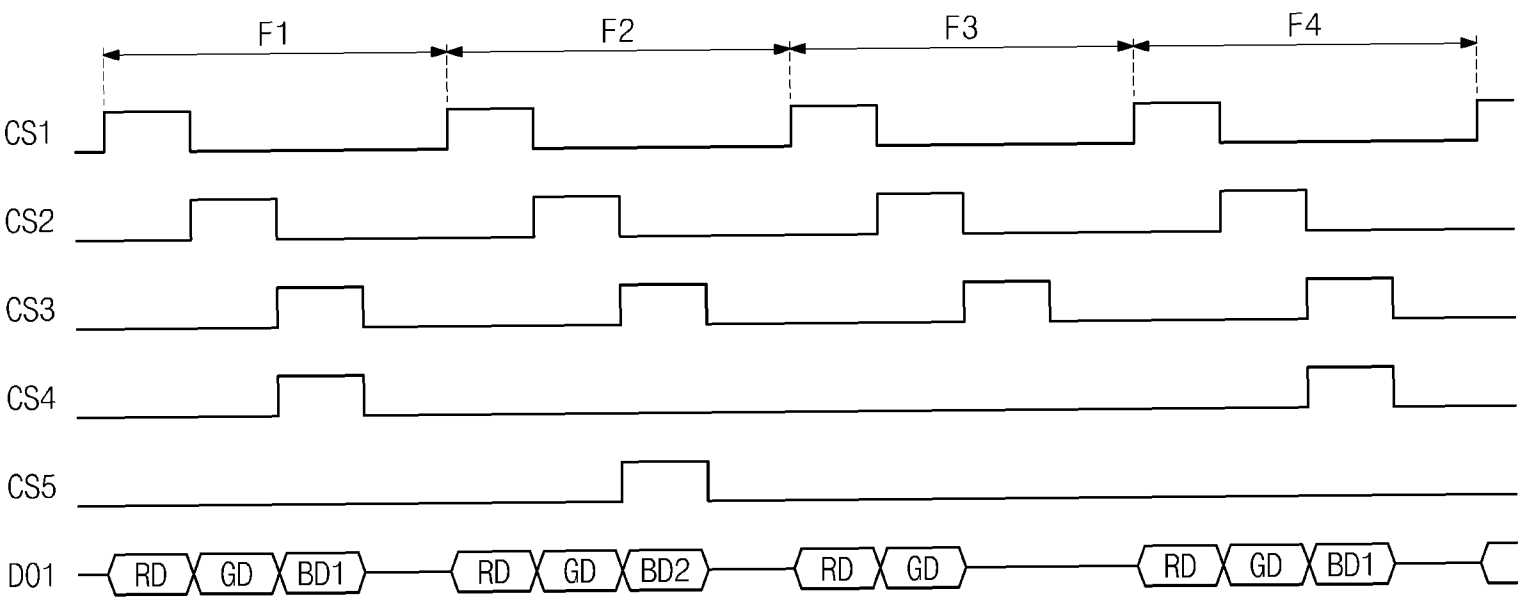
FIG. 10 is a timing diagram schematically illustrating a red selection signal, a green selection signal, a first blue selection signal, and a second blue selection signal output from a timing controller shown in FIG. 1 during a modified mix mode.

FIG. 10 is a timing diagram schematically illustrating a red selection signal, a green selection signal, a first blue selection signal, and a second blue selection signal output from a timing controller shown in FIG. 1 during a modified mix mode.

During the modified mix mode, a timing controller 120 activates a first blue selection signal CS4 high at the same time with a blue selection signal CS3 in a first frame F1, and it simultaneously activates the blue selection signal CS3 and the second blue selection signal CS5 high in a second frame F2.

That is, the first blue selection signal CS4 is activated high in frames F1, F4, F7 . . . , the second blue selection signal CS5 is activated high in frames F2, F5, F8 . . . , and the first and second blue selection signals CS4 and CS5 are set to a low level in frames F3, F6, F9 . . . . Colors expressed by pixels may be adjusted by modifying activation periods of the first and second blue selection signals CS4 and CS5.

Figure 11:
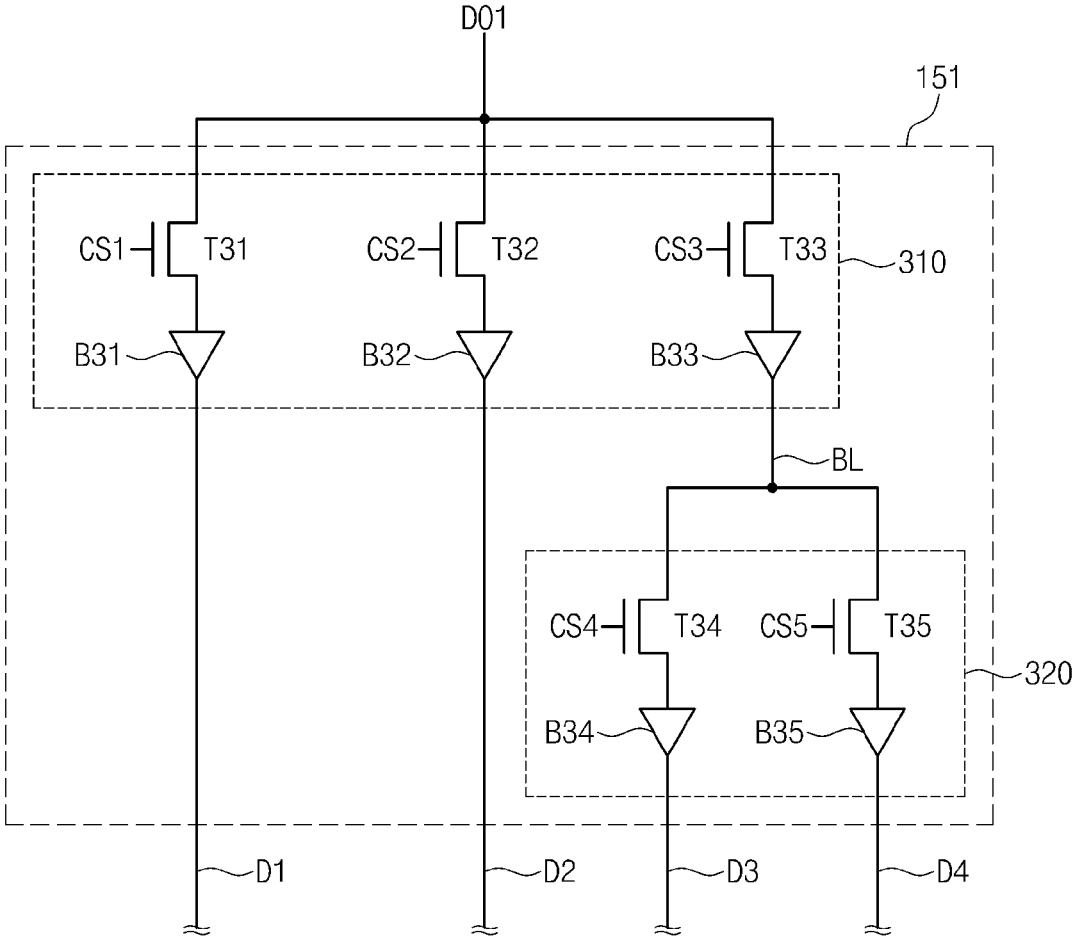
FIG. 11 is a circuit diagram schematically illustrating a de-multiplexer shown in FIG. 1, according to an exemplary embodiment of the present inventive concept.

FIG. 11 is a circuit diagram schematically illustrating a de-multiplexer shown in FIG. 1, according to an exemplary embodiment of the present inventive concept. In the exemplary embodiment, de-multiplexers 152 to 153 shown in FIG. 1 may be configured substantially the same as the de-multiplexer 151 shown in FIG. 11, and their detailed configurations are thus omitted.

Referring to FIG. 11, a de-multiplexer 151 includes a first selection circuit 310 and a second selection circuit 320. The first selection circuit 310 outputs a data output signal DO1 to one of a first data line D1, a second data line D2, and a blue line BL, in response to selection signals CS1 to CS3 from a timing controller 120 shown in FIG. 1. The selection signals CS1 to CS3 may be red, green, and blue selection signals.

The first selection circuit 310 includes first to third transistors T31 to T33 and first to third buffers B31 to B33. The first transistor T31 is connected to the data output signal DO1 and an input of the first buffer B31 and has a gate electrode connected to the red selection signal CS1. The second transistor T32 is connected to the data output signal DO1 and an input of the second buffer B32 and has a gate electrode connected to the green selection signal CS2. The third transistor T33 is connected to the data output signal DO1 and an input of the third buffer B33 and has a gate electrode connected to the blue selection signal CS3.

The first buffer B31 is connected between the first transistor T31 and the first data line D1, the second buffer B32 between the second transistor T32 and the second data line D2, and the third buffer B33 between the third transistor T3 and a blue line BL.

The second selection circuit 320 outputs the data output signal DO1 from the blue line BL to one of the third and fourth data lines D3 and D4 in response to selection signals CS4 and CS5 from the timing controller 120. The selection signals CS4 and CS5 may be first and second blue selection signals.

The second selection circuit 320 contains a fourth transistor T34, a fifth transistor T35, a fourth buffer B34, and a fifth buffer B35. The fourth transistor T34 is connected between the blue line BL and an input of the fourth buffer B34 and has a gate electrode connected to the first blue selection signal CS4. The fifth transistor T25 is connected between the blue line BL and an input of the fifth buffer B35 and has a gate electrode connected to the second blue selection signal CS5. The fourth buffer B34 is connected between the fourth transistor T34 and the third data line D3, and the fifth buffer B35 is connected between the fifth transistor T35 and the fourth data line D4.

The red selection signal CS1, green selection signal CS2, blue selection signal CS3, first blue selection signal CS4, and second blue selection signal CS5 may comply with timing shown in FIGS. 6, 7, 8, 9, and 10. The de-multiplexer 151 shown in FIG. 11 drives four data lines D1 to D4 using one data output signal DO1.

Figure 12:
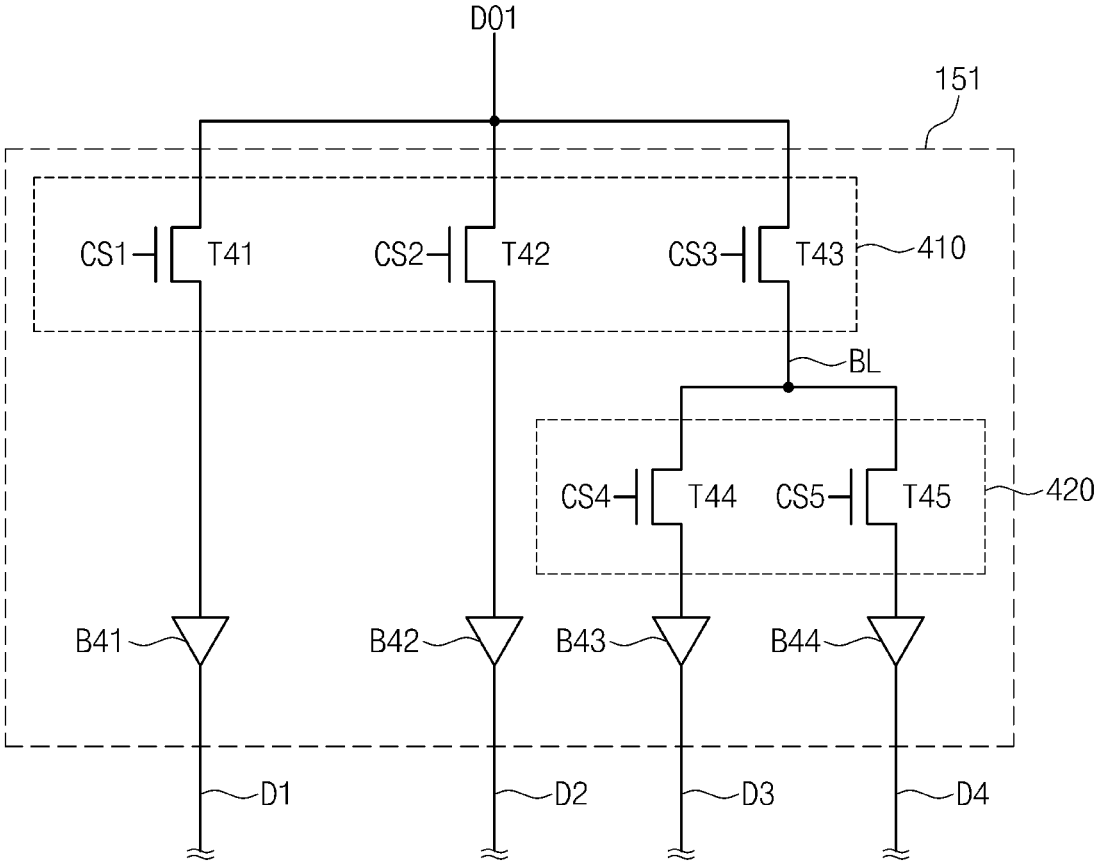
FIG. 12 is a circuit diagram schematically illustrating a de-multiplexer shown in FIG. 1, according to still an exemplary embodiment of the present inventive concept.

FIG. 12 is a circuit diagram schematically illustrating a de-multiplexer shown in FIG. 1, according to still an exemplary embodiment of the present inventive concept. In the exemplary embodiment, de-multiplexers 152 to 153 shown in FIG. 1 may be configured substantially the same as the de-multiplexer 151 shown in FIG. 12, and their detailed configurations are thus omitted.

Referring to FIG. 12, a de-multiplexer 151 includes a first selection circuit 410, a second selection circuit 420, and first to fourth buffers B41 to B44. The first selection circuit 410 outputs a data output signal DO1 to one of an input of the first buffer B41, an input of the second buffer B42, and a blue line BL, in response to selection signals CS1 to CS3 from a timing controller 120 shown in FIG. 1. The selection signals CS1 to CS3 may be red, green, and blue selection signals.

The first selection circuit 410 includes first to third transistors T41 to T43. The first transistor T41 is connected to the data output signal DO1 and an input of the first buffer B41 and has a gate electrode connected to the red selection signal CS1. The second transistor T42 is connected to the data output signal DO1 and an input of the second buffer B42 and has a gate electrode connected to the green selection signal CS2. The third transistor T43 is connected to the data output signal DO1 and the blue line BL and has a gate electrode connected to the blue selection signal CS3.

The second selection circuit 420 outputs the data output signal DO1 from the blue line BL to one of the third and fourth data lines D3 and D4 in response to selection signals CS4 and CS5 from the timing controller 120. The selection signals CS4 and CS5 may be first and second blue selection signals.

The second selection circuit 420 contains a fourth transistor T44 and a fifth transistor T45. The fourth transistor T44 is connected between the blue line BL and an input of the third buffer B43 and has a gate electrode connected to the first blue selection signal CS4. The fifth transistor T45 is connected between the blue line BL and an input of the fourth buffer B44 and has a gate electrode connected to the second blue selection signal CS5.

The first buffer B41 is connected between the first transistor T41 and the first data line D1, and the second buffer B42 is connected between the second transistor T42 and the second data line D2. The third buffer B43 is connected between the fourth transistor T44 and the third data line D3, and the fourth buffer B44 is connected between the fifth transistor T45 and the fourth data line D2.

The red selection signal CS1, green selection signal CS2, blue selection signal CS3, first blue selection signal CS4, and second blue selection signal CS5 may comply with timing shown in FIGS. 6, 7, 8, 9, and 10. The de-multiplexer 151 shown in FIG. 12 drives four data lines D1 to D4 using one data output signal DO1.

Figure 13:
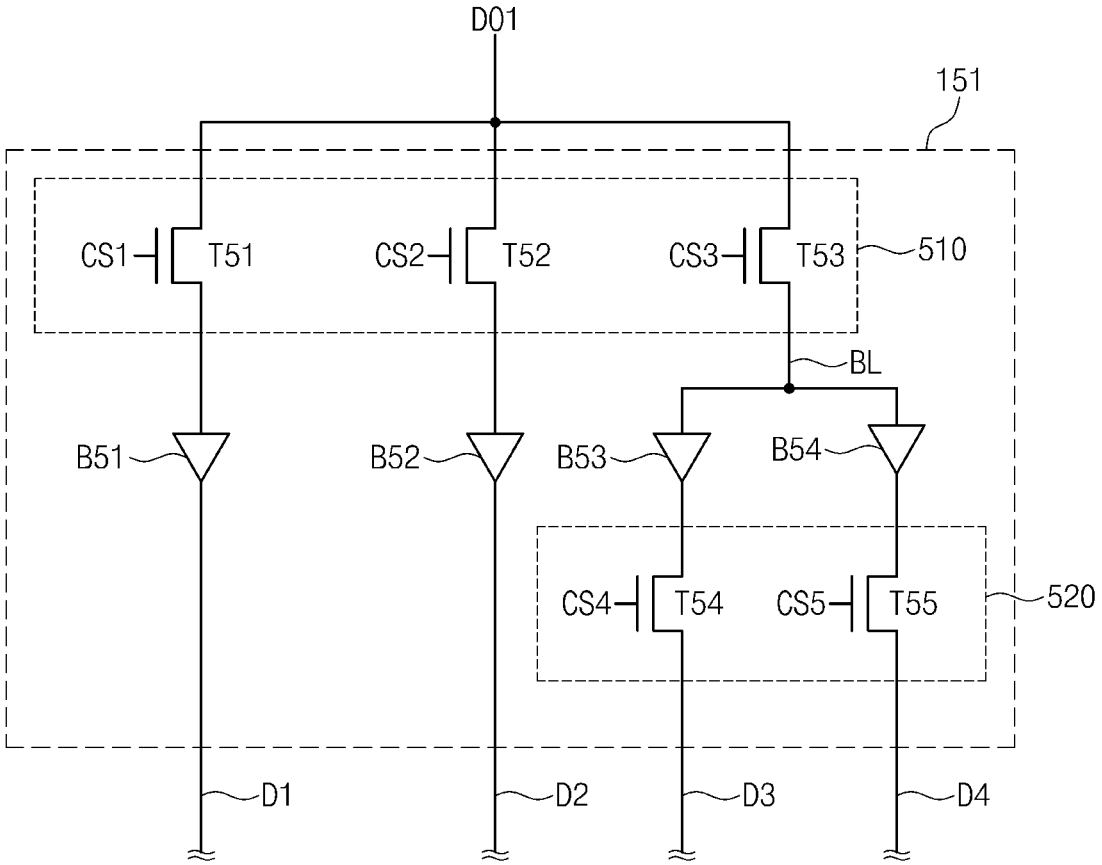
FIG. 13 is a circuit diagram schematically illustrating a de-multiplexer shown in FIG. 1, according to a further embodiment of the present inventive concept.

FIG. 13 is a circuit diagram schematically illustrating a de-multiplexer shown in FIG. 1, according to an exemplary embodiment of the present inventive concept. In the exemplary embodiment, de-multiplexers 152 to 153 shown in FIG. 1 may be configured substantially the same as the de-multiplexer 151 shown in FIG. 13, and their detailed configurations are thus omitted.

Referring to FIG. 13, a de-multiplexer 151 includes a first selection circuit 510, a second selection circuit 520, and first to fourth buffers B51 to B54. The first selection circuit 510 outputs a data output signal DO1 to one of an input of the first buffer B51, an input of the second buffer B52, and a blue line BL, in response to selection signals CS1 to CS3 from a timing controller 120 shown in FIG. 1. The selection signals CS1 to CS3 may be red, green, and blue selection signals.

The first selection circuit 510 includes first to third transistors T51 to T53. The first transistor T51 is connected to the data output signal DO1 and an input of the first buffer B51 and has a gate electrode connected to the red selection signal CS1. The second transistor T52 is connected to the data output signal DO1 and an input of the second buffer B52 and has a gate electrode connected to the green selection signal CS2. The third transistor T53 is connected to the data output signal DO1 and the blue line BL and has a gate electrode connected to the blue selection signal CS3.

The first buffer B51 is connected between the first transistor T51 and the first data line D1, and the second buffer B52 is connected between the second transistor T52 and the second data line D2. The third buffer B53 is connected between the blue line BL and a fourth transistor T54 of the second selection circuit 520, and the fourth buffer B54 is connected between the blue line BL and a fifth transistor T55 of the second selection circuit 520.

The second selection circuit 520 transfers output signals of the third and fourth buffers B53 and B54 to third and fourth data lines D3 and D4 in response to selection signals CS4 and CS5 from the timing controller 120. The selection signals CS4 and CS5 may be first and second blue selection signals.

The second selection circuit 520 contains the fourth transistor T54 and the fifth transistor T55. The fourth transistor T54 is connected between an output of the third buffer B53 and the third data line D3 and has a gate electrode connected to the first blue selection signal CS4. The fifth transistor T55 is connected between an output of the fourth buffer B54 and has a gate electrode connected to the second blue selection signal CS5.

The red selection signal CS1, green selection signal CS2, blue selection signal CS3, first blue selection signal CS4, and second blue selection signal CS5 may comply with timing shown in FIGS. 6, 7, 8, 9, and 10. The de-multiplexer 151 shown in FIG. 13 drives four data lines D1 to D4 using one data output signal DO1.

Figure 14:
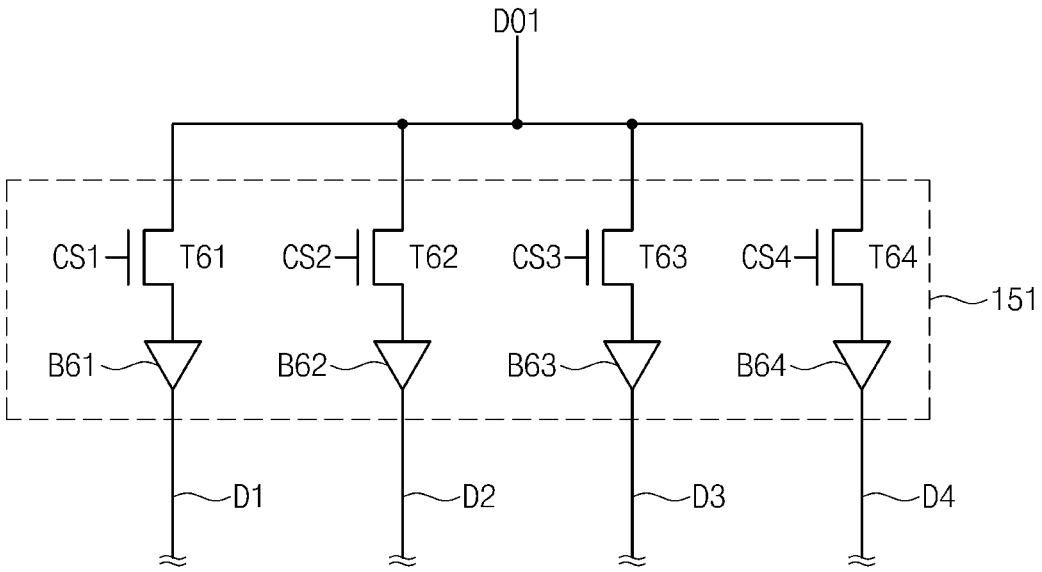
FIG. 14 is a circuit diagram schematically illustrating a de-multiplexer shown in FIG. 1, according to still an exemplary embodiment of the present inventive concept.

FIG. 14 is a circuit diagram schematically illustrating a de-multiplexer shown in FIG. 1, according to still an exemplary embodiment of the present inventive concept. In the exemplary embodiment, de-multiplexers 152 to 153 shown in FIG. 1 may be configured substantially the same as the de-multiplexer 151 shown in FIG. 14, and their detailed configurations are thus omitted.

Referring to FIG. 14, a de-multiplexer 151 includes first to fourth transistors T61 to T64 and first to fourth buffers B61 to B64. The first transistor T61 is connected between a data output signal DO1 and an input of the first buffer B61 and has a gate electrode connected to receive a red selection signal CS1. The second transistor T62 is connected between the data output signal DO1 and an input of the second buffer B62 and has a gate electrode connected to receive a green selection signal CS2. The third transistor T63 is connected between the data output signal DO1 and an input of the third buffer B63 and has a gate electrode connected to receive a first blue selection signal CS3. The fourth transistor T64 is connected between the data output signal DO1 and an input of the fourth buffer B64 and has a gate electrode connected to receive a second blue selection signal CS4.

The first buffer B61 is connected between the first transistor T61 and a first data line D1, and the second buffer B62 is connected between the second transistor T62 and a second data line D2. The third buffer B63 is connected between the third transistor T63 and a third data line D3, and the fourth buffer B64 is connected between the fourth transistor T64 and a fourth data line D4.

The red selection signal CS1, green selection signal CS2, first blue selection signal CS3, and second blue selection signal CS4 are sequentially activated high during a frame. A required blue color is expressed by adjusting activation periods of the first and second blue selection signals CS3 and CS4. Also, the de-multiplexer 151 shown in FIG. 13 drives four data lines D1 to D4 using one data output signal DO1.

Figure 15:
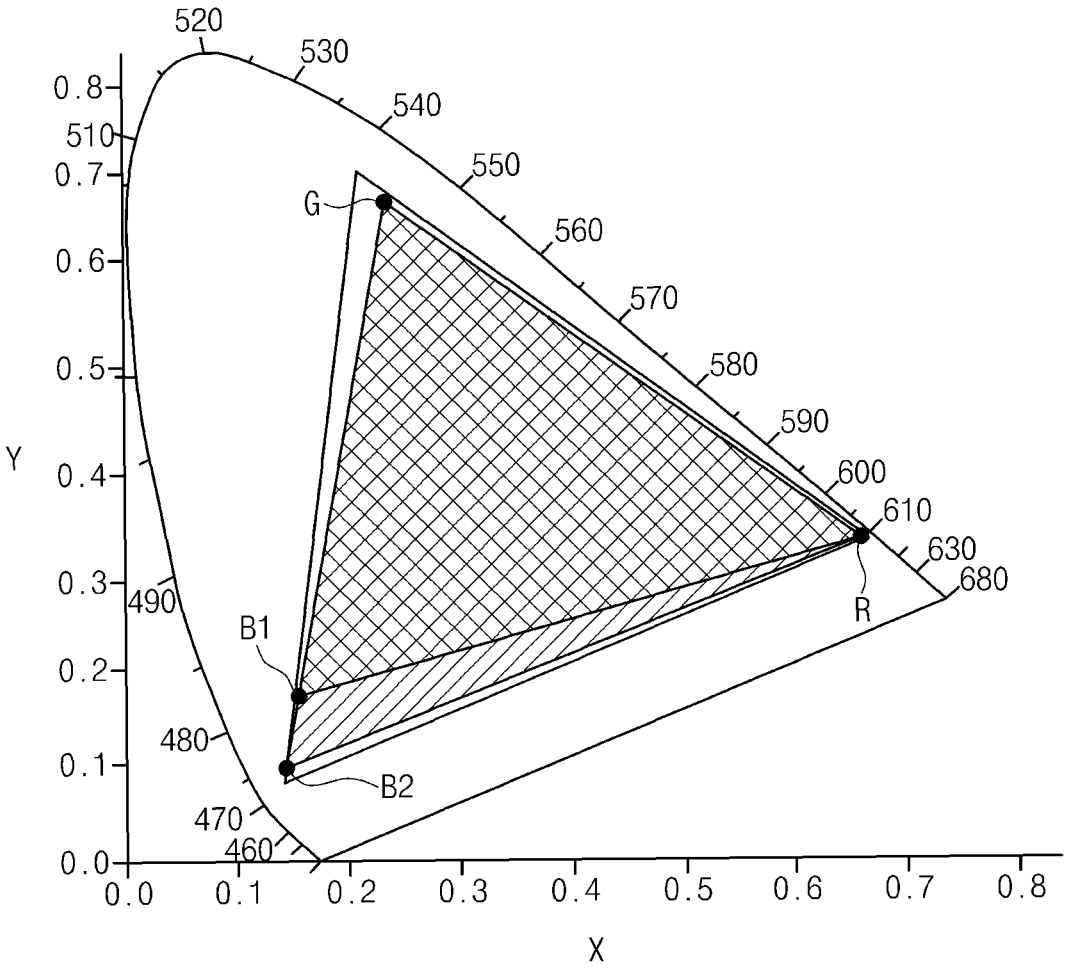
FIG. 15 is a diagram showing the CIE 1931 standard color coordinator.

FIG. 15 is a diagram showing the CIE 1931 standard color coordinator.

Referring to FIG. 15, coordinate values of first and second blue sub-pixels B1 and B2 may be different in the standard color coordinator. Accordingly, a color region defined by a red sub-pixel R, a green sub-pixel G, and a first blue sub-pixel B1 may be different from a color region defined by a red sub-pixel R, a green sub-pixel G, and a second blue sub-pixel B2. Thus, a color may be expressed by selectively turning on and off the first and second blue sub-pixels B1 and B2.

The first blue sub-pixel B1 emitting sky blue may extend a lifetime of an organic light emitting display device, and the second blue sub-pixel B2 emitting deep blue may improve a color gamut of an organic light emitting display device.

While the present inventive concept has been described with reference to exemplary embodiments, it will be apparent to those skilled in the art that various changes and modifications may be made without departing from the spirit and scope of the present invention. Therefore, it should be understood that the above embodiments are not limiting, but illustrative.

What is claimed is:

1. An organic light emitting display device comprising:

a display panel comprising a red sub-pixel, a green sub-pixel, a first blue sub-pixel, and a second blue sub-pixel each connected to one of a plurality of scan lines and one of a plurality of data lines;

a scan driver configured to drive the plurality of scan lines;

a data driver configured to receive a data signal and output a data output signal to a output terminal in response to the data signal;

a de-multiplexer circuit configured to sequentially provide the data output signal to a first data line, a second data line, a third data line, and a fourth data line, respectively, to the red sub-pixel, the green sub-pixel, the first blue sub-pixel, and the second blue sub-pixel, in response to a red selection signal, a green selection signal, a blue selection signal, a first blue selection signal and a second blue selection signal; and a timing controller configured to provide the data signal to the data driver, control the scan driver, and output the selection signals in response to an image signal and a control signal, wherein the de-multiplexer circuit comprises:

a first transistor connected between the output terminal of the data driver and the first data line and having a gate electrode connected to the red selection signal;

a second transistor connected between the output terminal of the data driver and the second data line and having a gate electrode connected to the green selection signal;

a third transistor connected between the output terminal of the data driver and a blue line and having a gate electrode connected to the blue selection signal;

a fourth transistor connected between the blue line and the third data line and having a gate electrode connected to receive the first blue selection signal; and a fifth transistor connected to the blue line and the fourth data line and having a gate electrode connected to the second blue selection signal, wherein the timing controller simultaneously activates the blue selection signal and one of the first blue selection signal and the second blue selection signal.

2. The organic light emitting display device of claim 1, wherein the timing controller is configured to output the first blue selection signal and the second blue selection signal in response to the image signal such that the data output signal is provided alternatively to the first blue sub-pixel and the second blue sub-pixel each frame.

3. The organic light emitting display device of claim 1, wherein the timing controller is configured to output the first blue selection signal and the second blue selection signal in response to the image signal such that the data output signal is not provided to the first blue sub-pixel and the second blue sub-pixel during a predetermined frame.

4. The organic light emitting display device of claim 1, wherein the timing controller is configured to output the first blue selection signal and the second blue selection signal in response to the image signal to operate in either a first blue mode, in which the data output signal is provided to the first blue sub-pixel, or a second blue mode, in which the data output signal is provided to the second blue sub-pixel.

5. The organic light emitting display device of claim 1, wherein the de-multiplexer circuit further comprises:

a first buffer connected between the first transistor and the first data line;

a second buffer connected between the second transistor and the second data line; and a third buffer connected between the third transistor and the blue line.

6. The organic light emitting display device of claim 1, wherein the de-multiplexer circuit further comprises:

a fourth buffer connected between the fourth transistor and the third data line; and a fifth buffer connected between the fifth transistor and the fourth data line.

7. The organic light emitting display device of claim 1, wherein the de-multiplexer circuit further comprises:

a first buffer connected between the first transistor and the first data line;

a second buffer connected between the second transistor and the second data line;

a third buffer connected between the fourth transistor and the third data line; and a fourth buffer connected between the fifth transistor and the fourth data line.

8. The organic light emitting display device of claim 1, wherein the first blue sub-pixel and the second blue sub-pixel have different coordinate values in a color coordinator.

* * * * *